United States Patent [19]

Colman et al.

[11] 4,131,043

[45] Dec. 26, 1978

[54] FOOD-SLICING DEVICE

[75] Inventors: Benjamin W. Colman, 8616 Nadine Ave., Huntington Woods, Mich. 48070; Montgomery Ferar, Huntington Woods, Mich.

[73] Assignee: Benjamin W. Colman, Huntington Woods, Mich.

[21] Appl. No.: 740,732

[22] Filed: Nov. 10, 1976

[51] Int. Cl.[2] ..... B26D 4/42

[52] U.S. Cl. ..... 83/167; 83/761; 83/762; 269/321 N.

[58] Field of Search ..... 83/761, 762, 763, 167; 269/13, 15, 321 N; 30/124

[56] References Cited

U.S. PATENT DOCUMENTS

| | | | |
|---|---|---|---|
| 1,953,137 | 4/1934 | Streckfuss | 83/762 |
| 2,352,125 | 6/1944 | Sager | 83/762 |
| 2,649,658 | 8/1953 | Nelson | 83/761 |
| 3,843,110 | 10/1974 | Smith | 269/321 N |
| 3,971,273 | 7/1976 | Peters et al. | 83/762 |

*Primary Examiner*—Donald R. Schran
*Attorney, Agent, or Firm*—Benjamin W. Colman

[57] ABSTRACT

A food-slicing device having a food supporting cradle formed of a pair of vertically upstanding lateral wall members and an intermediate web section therebetween, the wall members diverging upwardly and outwardly from the web section, and an anvil tray or platform section extending forwardly of the leading edges of the lateral wall members and web section to receive sliced food material produced upon cutting the food in a plane closely adjacent the leading edges of the wall members and web section.

17 Claims, 8 Drawing Figures

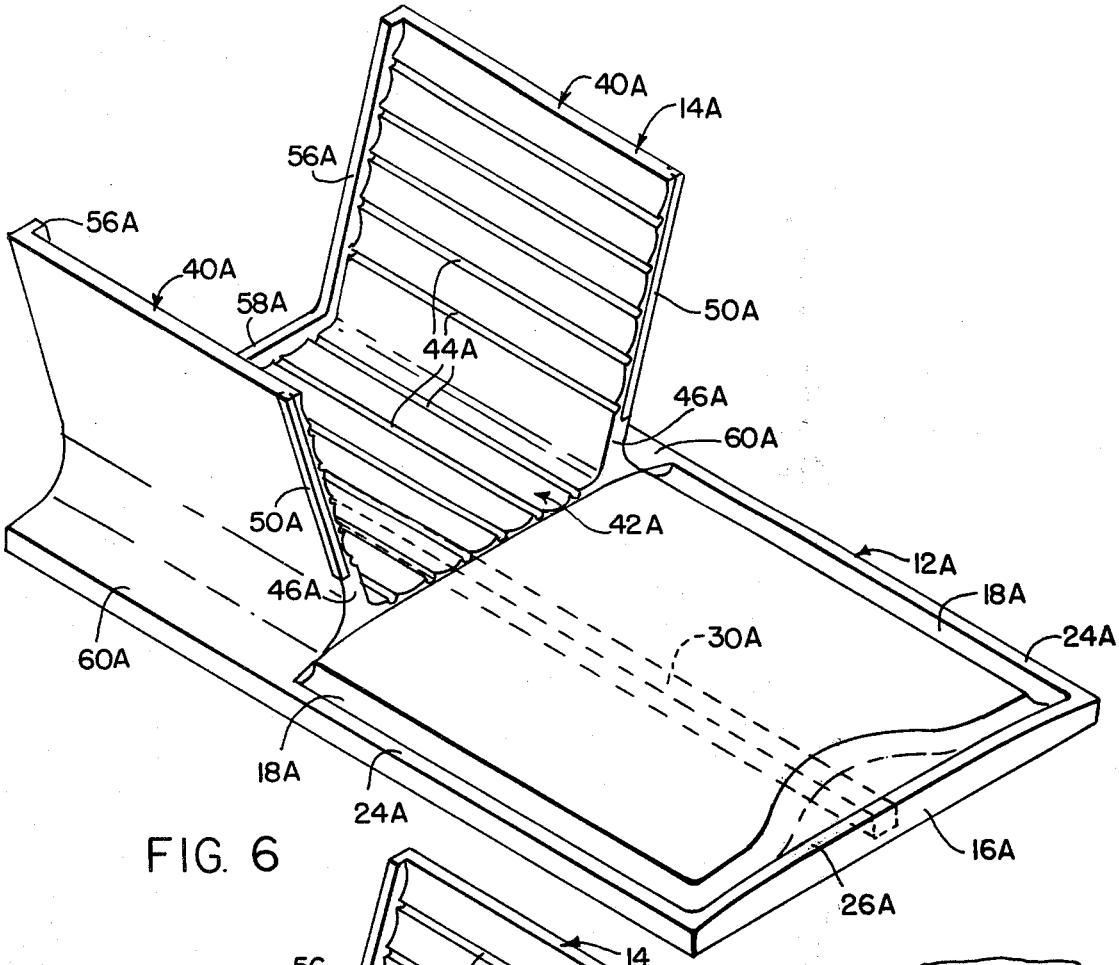
FIG. 6
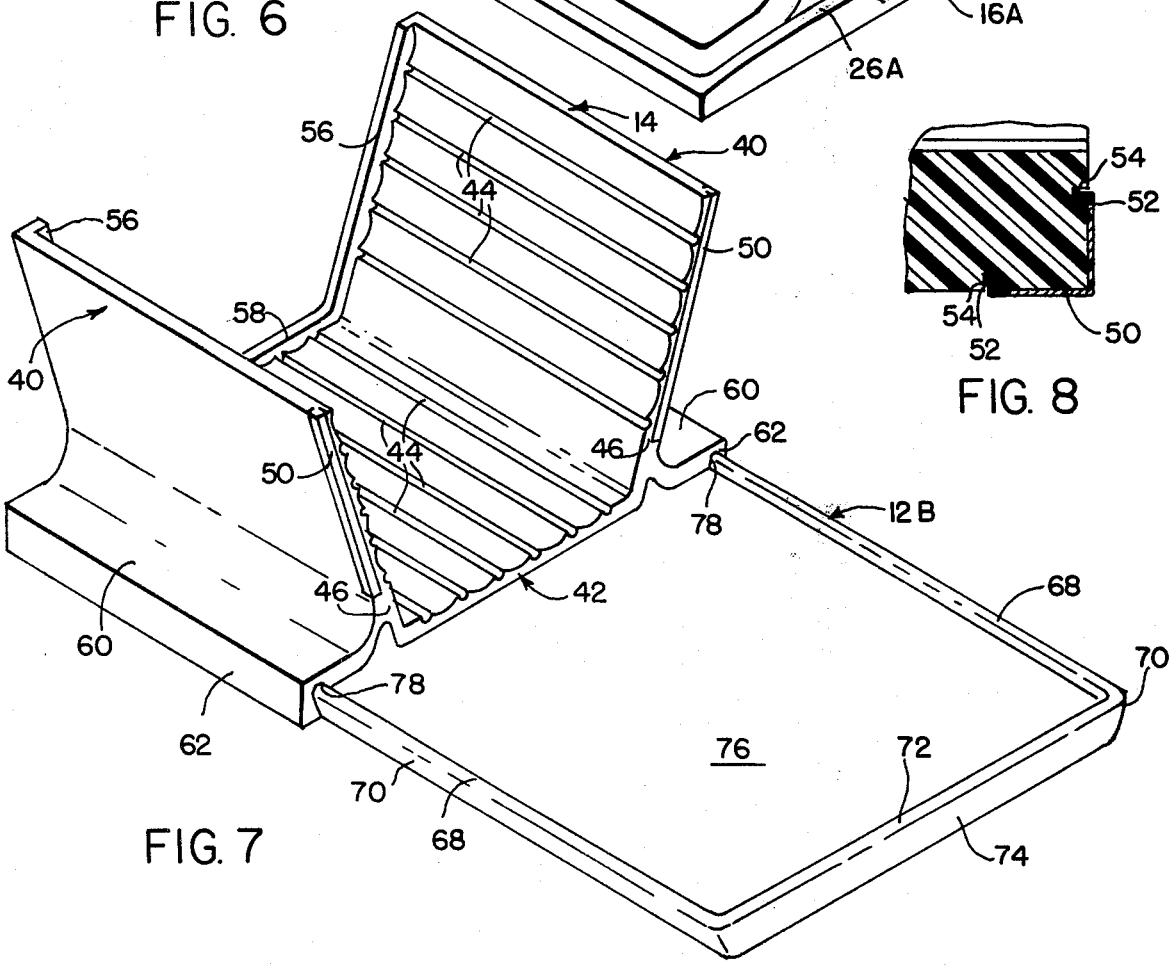
FIG. 7
FIG. 8

FOOD-SLICING DEVICE

BACKGROUND OF THE INVENTION

The field of art to which the invention pertains includes food-slicing devices, cutting boards and similar food-processing equipment.

Devices for and associated with the slicing or cutting of foods include cutting boards, meat holders, meat supports, slicing machines, manual or electric, and various styles of cutting blades associated with such devices.

SUMMARY OF THE INVENTION

The present invention provides for a cradle adapted to hold food to be sliced or cut and an anvil tray connected to and associated with the cradle to receive the sliced cut food material and to provide an anvil for the cutting blade. The cradle is essentially a pair of upwardly directed lateral wall members, arranged substantially in opposing spaced apart relationship, diverging upwardly and outwardly from an intermediate connected web section. The cradle is open at each end to permit the input of food to be sliced or cut and a discharge of the sliced food material. The angulated cradle wall members permit the food item to be moved upon the web section toward the slicing end of the cradle where a knife can be applied in thrust relationship to the forward leading edges of the cradle wall members and the web section. An anvil for the cutting blade or knife is provided by a tray which can either be integrally formed with the cradle or separately formed and attached to the cradle so that the cutting blade can sever the food product upon the anvil surface if it has not done so at the edge of the cradle web section. The separate sliced food receiving anvil tray can be telescoped within the outer lateral edges or legs of the cradle base adapted to engage the lateral edges of the anvil tray.

The forward leading edges of the cradle, if the cradle is made of a plastic material, are preferably provided with metallic molding or facing strips so that as the cutting blade bears in thrust relationship against such edges, they will not be cut, nicked or sliced by the cutting blade. If the metal molding strips are made of a slightly abrasive metallic-type material, they can also serve to sharpen the edge of the cutting blade as it is passed thereover in contact with such strips.

Because the cradle wall members extend upwardly and diverge outwardly, the food product placed thereon for slicing, if large enough, is wedged between the cradle wall members for more positive support during the slicing operation. The cradle wall members and web section are also provided with longitudinally extending projections, ribs or ridges so that as the food product is sliced and the bulk or mass is diminished, the product remaining in the cradle can be easily moved on or along these ribs toward the forward edges of the cradle where slicing occurs.

Where desired or required, as in the case of slicing a meat product, the anvil tray can be provided with juice-receiving grooves and a juice-collecting well communicating therewith.

BRIEF DESCRIPTION OF THE DRAWINGS

Various further and more specific objects, features and advantages of the invention will appear from the description given below, taken in connection with the accompanying drawings, illustrating by way of example preferred forms or embodiments of the invention. Reference is here made to the drawings annexed hereto and forming an integral part of this specification, in which

FIG. 6 is a perspective view of a unitary cradle and anvil tray, a modification of the embodiment illustrated in FIGS. 1–5 inclusive.

FIG. 7 is a further modification of the two-piece cradle and anvil tray embodiment illustrated in FIGS. 1–5 inclusive.

FIG. 8 is a fragmentary horizontal sectional view taken substantially on the line 8—8 of FIG. 1.

DESCRIPTION OF PREFERRED EMBODIMENTS

Figure 1:
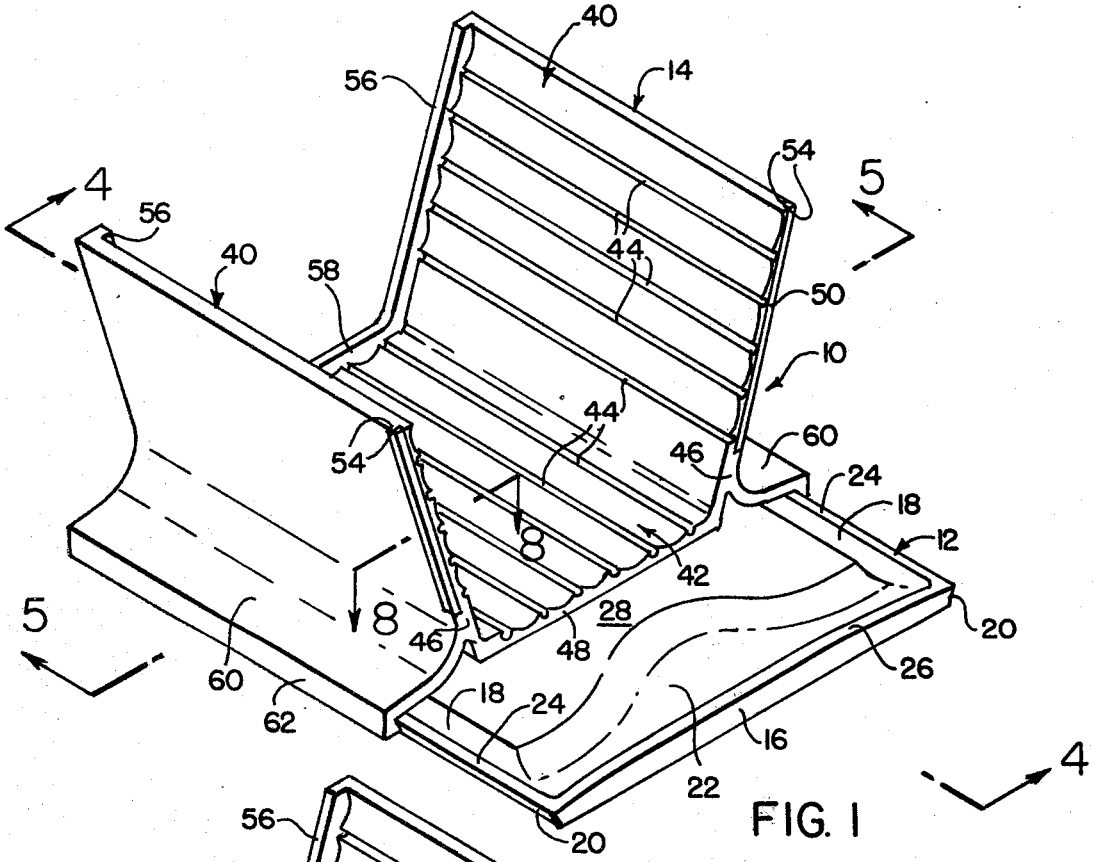
FIG. 1 is a perspective view of a preferred embodiment of the invention.
Figure 2:
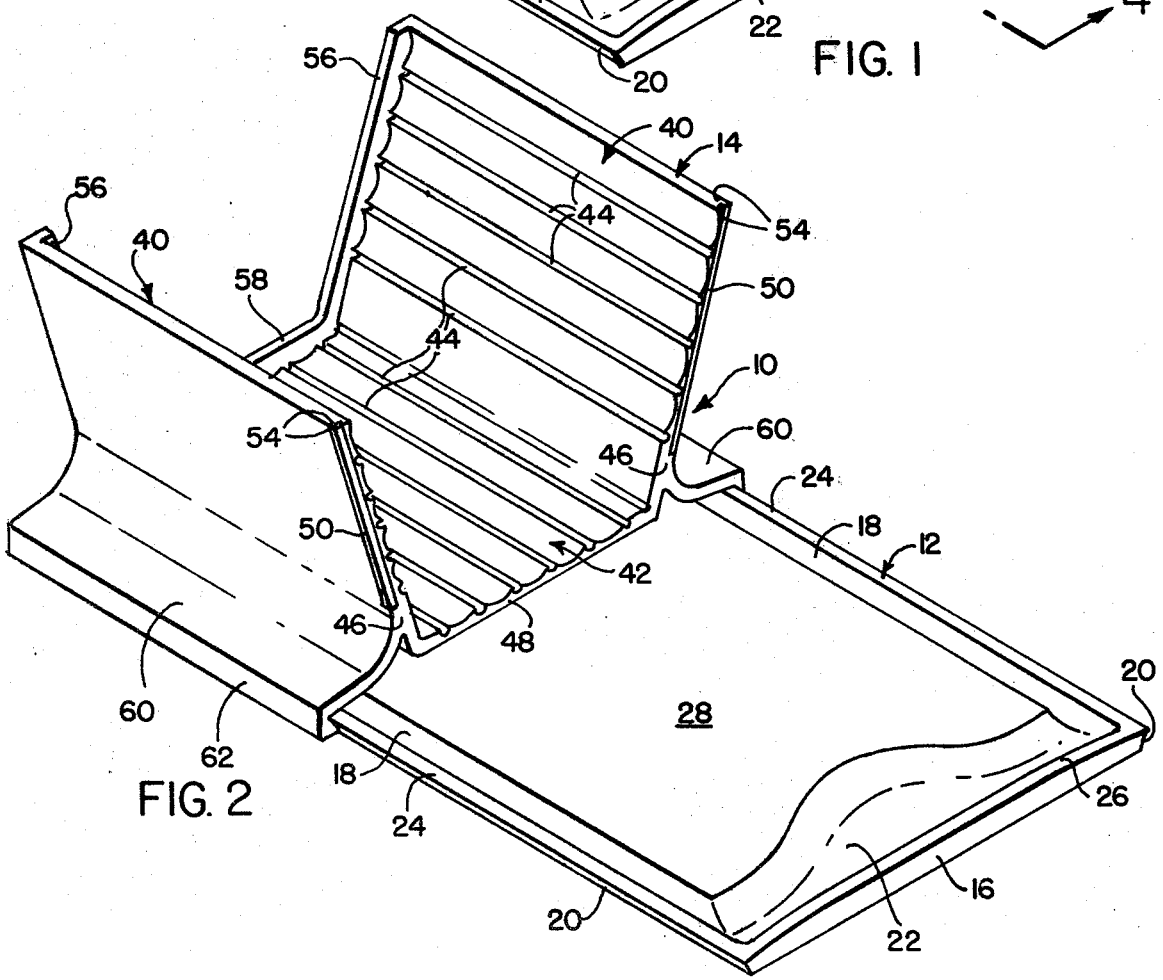
FIG. 2 is a view similar to the illustration in FIG. 1, with the anvil tray being extended from its more telescoped position under the base of the cradle.
Figure 3:
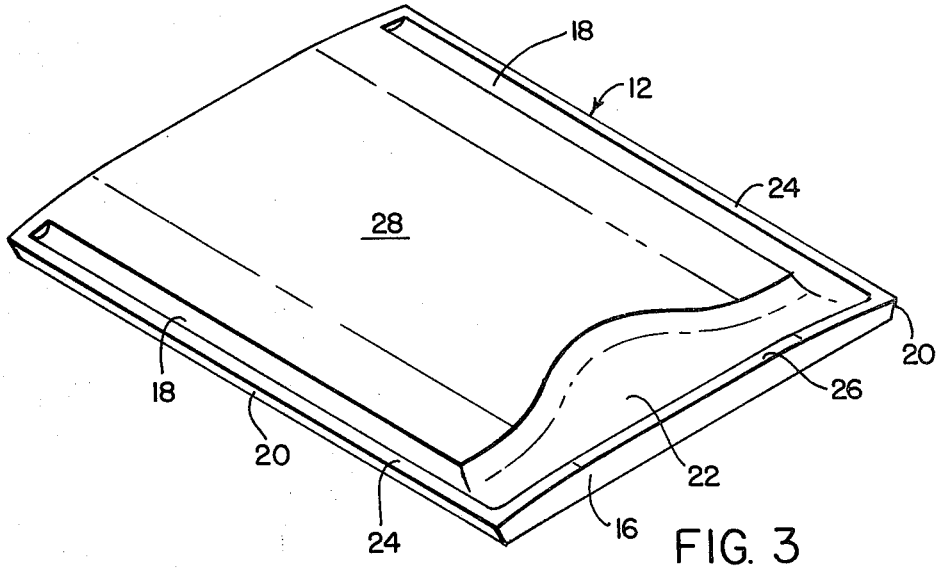
FIG. 3 is a perspective view of the anvil tray illustrated only partially in FIGS. 1 and 2.
Figure 4:
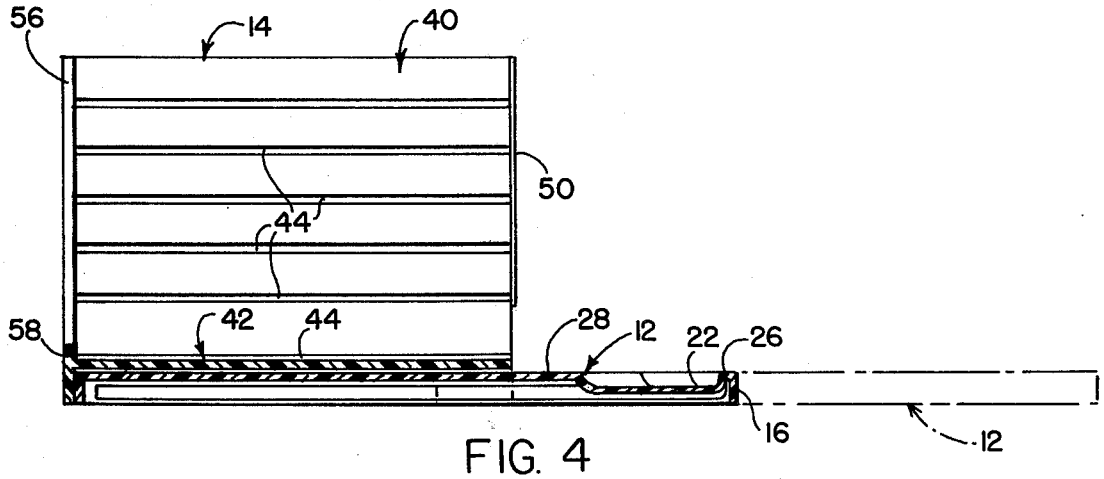
FIG. 4 is a vertical elevational view, partially in section, taken substantially on the line 4—4 of FIG. 1.
Figure 5:
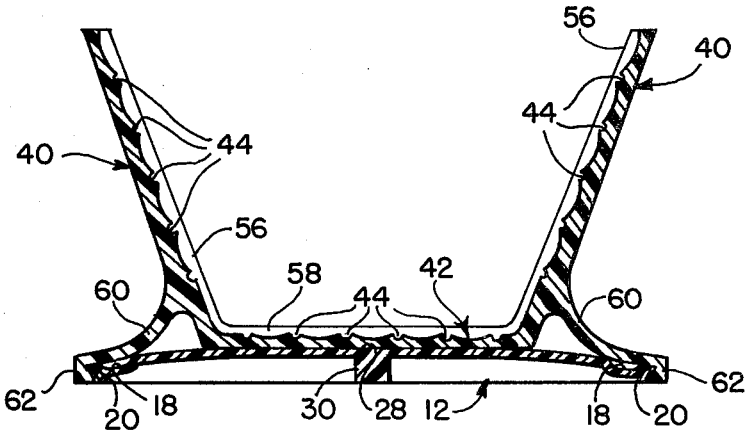
FIG. 5 is a transverse vertical sectional view through the cradle and anvil tray, taken substantially on the line 5—5 of FIG. 1.

As illustrated particularly in FIGS. 1–5 inclusive, a preferred embodiment of the invention comprises the food supporting cradle and anvil tray combination 10 in which the anvil tray 12 is telescopically conjoined with the base of the cradle 14 by means and in the manner more particularly described hereinafter below.

The anvil tray 12 comprises a body 16 having a pair of juice-receiving grooves 18,18 adjacent the lateral edges 20,20 which are downwardly and inwardly inclined. The lateral juice-receiving grooves 18,18 extend to the forward end of the anvil tray and communicate with a well 22. Thus, the lateral and forward edges of the anvil tray are provided with a gallery comprising the border flanges or ribs 24, 24 and 26. The medial longitudinally extending portion of the anvil tray has a slightly crowned upper surface 28 so that liquids or juices discharged by the slicing action will run downwardly from the crowned surface into the receiving wells 18,18 and there carried by gravity, due to the sloping surface of the grooves, to the receiving well 22.

The anvil tray 12 is preferably molded of a suitable plastic material adapted to withstand the cutting forces of the slicing blade engaged upon the crowned surface 28. To strengthen the anvil tray in its medial portion, a supportive longitudinally extending medial rib 30 is provided in its base. The anvil tray can be molded as an integral unitary part of plastic or other suitable composition material.

The cradle 14 comprises the lateral upstanding outwardly diverging wall members 40,40 conjoined to and preferably integrally formed with the medial web section 42. The interior surfaces of the cradle, side walls and intermediate web section are provided with projections, ridges or ribs 44 terminating in relatively fine edges that engage the food product placed thereon. These ridges on the web section 42 and the walls 40,40 tend to check the food product against lateral movement and displacement. Although the ridges 44 are shown having two closely adjacent parallel fine edges, the nature of such ridges or projections is optional and modified forms of such ridges, or projections of other forms, on the inner surfaces of the cradle wall members 40,40 and intermediate web section 42 are nevertheless considered to come within the scope of the invention. The provision of ridges on these interior surfaces tends to check lateral and upward sliding movement of a food product placed in contact therewith. The direction of more facile translation for the food product is longitudinally of the cradle between the wall members toward the forward edges 46,46 of the wall members and the edge 48 of the intermediate web section, these edges lying in a plane.

As a protective covering to prevent nicking, cutting or slicing of the forward edges 46,46 by the cutting edge of a blade, the outer corners of these edges are provided with metallic facing angles 50,50 having lateral inturned flanges 52,52 adapted to seat in grooves 54,54 at the front and outer side surfaces of these corners, whereby the facing angles are secured to the cradle wall edges. These grooves extend upwardly to the top surface of the cradle wall members 40,40 permitting the angles 50,50 to be slid over the outer corners of the wall members and downwardly to a seated position substantially as illustrated.

The input end of the cradle 14, at the outer edges of the wall members 40,40 and the intermediate web section 42, is provided with inwardly directed flanges 56,56 and the upstanding flange 58 therebetween and connected thereto, as a gallery or fence for the food product placed upon the cradle.

The base of the cradle 14 comprises the lateral outwardly directed flange portion 60,60 and the body of the intermediate web section 42, the lateral flange portions terminating at their edges in downwardly directed legs 62,62 having their inner surfaces inclined downwardly and inwardly in an attitude complementary to and adapted to receive the anvil tray legs 20,20 therebetween, the legs of the cradle and of the anvil tray dovetailing so that when the cradle is elevated, the anvil tray will not fall therefrom but remain engaged upon the mating surfaces of their respective legs.

A first modification of the embodiment of the invention illustrated in FIGS. 1–5 is that illustrated in FIG. 6, wherein the anvil tray 12*a* and the cradle 14*a* are integrally formed, or combined by cementation or other fusion or coupling process into a unitary food-slicing device. The anvil tray 12*a* is not extensible but is fixed in relationship to the cradle 14*a*, extending forwardly from the cradle intermediate web section adjacent the cradle wall edges 46*a*,46*a*. The lateral edges of the anvil tray 12*a* are substantially vertical and lie substantially in the same plane as the lateral edges of the cradle flanges 60*a*,60*a*. The intermediate supporting rib 30 (FIG. 5), applied in the modification illustrated in FIG. 6, extends from the inner surface of the forward edge 16*a* of the anvil tray to the outer intermediate web section flange 58*a* at the input end of the cradle 14*a*, to provide medial support for the cradle and anvil tray in and for the slicing operation. This intermediate supporting rib 30*a* is illustrated in broken lines in FIG. 6.

A second modification of the food-slicing device illustrated in FIGS. 1–5 inclusive is that shown in FIG. 7, wherein the cradle 14 is now combined with a telescoping anvil tray 12*b* having lateral upstanding flanges 68,68 and adjacent downwardly and inwardly inclined side walls 70,70 that are complementary to the inner surfaces of the cradle legs 62 for sliding engagement therewith, similar to the telescoping relationship of the side walls 20,20 of the anvil tray 12 (FIGS. 1, 2, 3 and 5).

The forward leading edge of the anvil tray 12*b* comprises the upstanding flange 72 lying in the same plane as the lateral flanges 68,68 and connected thereto, to form a gallery or fence on three sides of the anvil tray. The anvil tray 12*b* having a peripheral support in the forward wall 74 and the lateral walls 70,70 can also be provided with a longitudinally extending supporting rib, similar to the ribs 30 or 30*a*, under the medial portion of the tray anvil surface 76 for adequate support in slicing the food product and the slices falling upon such surface. The anvil surface 76 is substantially planar and extends from the lateral ribs 68,68 and the forward rib 72 to the rearward edge of the tray. The intermediate anvil surface 76, though shown in planar form and so described above, can be crowned with a relatively higher medial longitudinally extending surface than that adjacent each of the lateral ribs or flanges 68,68, as in the case of the anvil tray 12. In this form of anvil tray, the medial crowned surface and the lateral flanges 68,68 form grooves to receive juices or liquids generated in the slicing operation. The lateral flange portions 60,60 of the cradle 14 are provided with longitudinally extending grooves 78,78 above the legs 62,62 to accommodate the lateral upstanding flanges 68,68 of the anvil tray 12*b*, for telescoping relationship of the anvil tray and the cradle.

Operation

The food-slicing device 10 is utilized in the following manner. A food product (or any other commodity suitable for and requiring a cutting or slicing operation) is placed upon the web section 42 between the wall members 40,40 and moved forwardly thereon until a portion of the product projects beyond the forward edges 46,46 and 48 of the cradle a distance substantially equal to the amount one desires to slice or cut off. The food product is held by the fingers of the hand or by a tool or implement to maintain it firmly upon the cradle. Normally and preferably, the fingers, tool or implement are positioned rearwardly of the forward edges to prevent personal injury or damage when the cutting blade of a knife or other cutting or slicing instrument is applied to the food product. The blade is brought downwardly upon the food product closely adjacent the facing angles 50,50 and substantially parallel thereto, using the facing angles as a thrust surface and guide in the slicing operation. With a sawing or slicing motion, the blade will cut through, or nearly through the food product at the upper surface of the web section 42 and its forward edge 48. But if the slice or cut is not completely severed, the blade will continue downwardly to the crowned surface 28 or 28*a*, or the planar surface 76 of the anvil trays 12, 12*a* and 12*b* respectively, to sever the slice from the mass of food product remaining on the cradle. The slices will collect upon the anvil tray, from which they can be removed for serving by conventional means, one or more at a time.

The lengths, widths and thicknesses of the structural features of the cradle and the anvil tray are, of course, optional and selective, readily determinable for any particular application(s). The cradle and anvil tray are preferably made of a moldable plastic or composition material, in unitary form to the extent permitted by the design adopted for each unit. The corner angles 50,50 are preferably made of a thin stainless steel strip material, preformed for mounting upon the cradle corners in the grooves 54,54.

Although particular embodiments of the invention have been disclosed herein for purposes of explanation, further modifications or variations thereof, after study of this specification, will or may become apparent to those skilled in the art to which the invention pertains. Reference should be had to the appended claims in determining the scope of the invention.

We claim:

1. In a slicing device, the improvement comprising in combination a cradle having upstanding outwardly diverging walls disposed at an acute angle to each other and spaced apart from each other by an intermediate substantially horizontal web section therebetween of substantial width connected to said walls and adapted to receive and support thereon a product to be sliced, said walls and web section being commensurate with and of a length sufficient to support said product thereon, and an anvil tray having a generally planar area adapted to receive and support the slices cut from said product, associatedly conjoined to said cradle, extending forwardly thereof in a plane below the product-supporting plane of said intermediate web section, and adapted to receive the cutting edge of a blade slicing the portion of said product extending beyond the forward edges of said cradle walls and web section.

2. The slicing device defined in claim 1, and wherein said cradle further comprises lateral longitudinally extending flange portions commensurate with, conjoined to and extending outwardly of said walls at their bases for elevating said walls and intermediate web section above a rest plane supporting said device, said lateral flange portions having depending legs engageable with the lateral longitudinally extending edges of said anvil tray for sliding movement of said tray relative to said cradle thereunder, said legs elevating said flange portions, cradle walls and web section above said anvil tray and said rest plane, said anvil tray telescopically engageable with and conjoined to said cradle at said legs.

3. The slicing device defined in claim 2, wherein said cradle walls, web section and lateral flange portions comprise a unitary implement or utensil molded of a plastic or composition material.

4. The slicing device defined in claim 3, wherein said unitary implement or utensil is integrally formed.

5. The slicing device defined in claim 1, wherein said cradle walls and web section are provided with longitudinally extending product engaging spaced apart ridges on their product contacting surfaces adapted to resist transverse movement of said product placed thereon for and during slicing operation.

6. The slicing device defined in claim 1, and wherein the forward edges of said cradle walls are provided at least in part with a protective metallic covering and facing.

7. The slicing device defined in claim 6, wherein said protective metallic covering and facing comprises an angle having lateral inturned flanges, the forward and lateral edge surfaces of said cradle wall having complementary slots therein adapted to seat said angle lateral flanges, to retain said metallic covering and facing on said cradle wall forward edges.

8. The slicing device defined in claim 1, wherein the upper surface of said anvil tray intermediate its lateral edge portions is slightly crowned transversely.

9. The slicing device defined in claim 2, wherein said anvil tray lateral edge surfaces are substantially complementary with the inner surfaces of said cradle flange portion legs.

10. The slicing device defined in claim 8, wherein said lateral edge portions are provided with liquid receiving grooves extending longitudinally adjacent and inwardly of the lateral edges of said anvil tray, said crowned upper surface lying intermediate said grooves.

11. The slicing device defined in claim 10, and wherein said anvil tray is further provided at its forward end with a liquid receiving well communicating with said lateral grooves and adapted to receive liquid therefrom.

12. The slicing device defined in claim 1, wherein said anvil tray is formed of a molded plastic or composition material as a unitary implement or utensil.

13. The slicing device defined in claim 1, wherein said cradle and anvil tray are integrally formed as a unit of a plastic or composition material.

14. The slicing device defined in claim 1, wherein the upper surface of said anvil tray intermediate its lateral edge portions is substantially planar.

15. In a slicing device, the improvement comprising in combination, a cradle for a product to be cut or sliced having upstanding outwardly diverging wall members disposed at an acute angle to each other and an intermediate substantially horizontal web section therebetween of substantial width connected to said wall members and adapted to receive and support said product thereon, said wall members and web section being commensurate with and of a length sufficient to support said product thereon, and lateral longitudinally extending flange portions commensurate with, conjoined to and extending outwardly of said wall members at their bases for elevating said walls and web section above a rest plane supporting said device, said lateral flange portions having depending legs elevating said flange portions, cradle walls and intermediate web section above said rest plane.

16. The slicing device defined in claim 15, wherein said cradle comprises a unitary implement or utensil molded of a plastic or composition material.

17. The slicing device defined in claim 16, wherein said unitary implement or utensil is integrally formed.

* * * * *